US009926706B2

(12) United States Patent
Hockman

(10) Patent No.: US 9,926,706 B2
(45) Date of Patent: Mar. 27, 2018

(54) SNOW GUARD

(71) Applicant: Mark Hockman, Westtown, PA (US)

(72) Inventor: Mark Hockman, Westtown, PA (US)

( * ) Notice: Subject to any disclaimer, the term of this patent is extended or adjusted under 35 U.S.C. 154(b) by 0 days.

(21) Appl. No.: 14/670,925

(22) Filed: Mar. 27, 2015

(65) Prior Publication Data

US 2016/0281365 A1 Sep. 29, 2016

(51) Int. Cl.
*E04D 13/00* (2006.01)
*E04D 13/10* (2006.01)
*E04D 3/16* (2006.01)

(52) U.S. Cl.
CPC ..... *E04D 13/10* (2013.01); *E04D 3/16* (2013.01)

(58) Field of Classification Search
CPC ..... E04D 13/10; E04D 13/03–13/16; F24J 2/5249; B05C 17/00; B05C 17/02; B05C 17/0207
USPC ..... 52/24
See application file for complete search history.

(56) References Cited

U.S. PATENT DOCUMENTS 939,516 A * 11/1909 Laird ..... E04D 13/10 52/25
2,777,148 A * 1/1957 Belsky ..... A47L 13/257 15/176.6
2,810,148 A * 10/1957 Wood, Jr. ..... B05C 17/00 118/207
5,282,340 A * 2/1994 Cline ..... E04D 13/10 52/24
5,522,185 A * 6/1996 Cline ..... E04D 13/10 52/24
5,655,334 A * 8/1997 Kwiatkowski ..... E04D 13/10 52/24
6,546,584 B2 * 4/2003 Hobden ..... B05C 17/00 15/144.1
7,174,677 B1 * 2/2007 Dressler ..... E04D 13/10 52/24
7,213,373 B2 * 5/2007 Hockman ..... E04D 13/10 248/535
7,487,617 B2 * 2/2009 Hockman ..... E04D 13/10 248/535
7,774,989 B2 * 8/2010 Fisher ..... E04D 13/10 52/24

(Continued)

OTHER PUBLICATIONS

Sno Gem 3" seam mount found on wayback machine dated Sep. 12, 2014 at: https://web.archive.org/web/20140921063811/http://www.snogem.com/models.html#individual.*

(Continued)

*Primary Examiner* — Brian D Mattei
(74) *Attorney, Agent, or Firm* — Stephen J. Weyer, Esq.; Stites & Harbison, PLLC

(57) ABSTRACT

A snow guard includes a plate having a front side and a back side, a first and second flange extending from the opposite edges of the front side of the plate, wherein the first flange defines a first vertical slot and the second flange defines a second vertical slot, such that the first vertical slot faces the second vertical slot. The snow guard also including base extending from the back side of the plate and terminating in a distal end. A groove is defined through the plate and the base, the groove extending from the front side of the plate to the distal end of the base, and one or more holes extend transversely through the base, the one or more holes in communication with the groove.

21 Claims, 8 Drawing Sheets

(56) References Cited

U.S. PATENT DOCUMENTS

| | | | | |
|---|---|---|---|---|
| 2010/0000161 | A1* | 1/2010 | Fisher | E04D 13/10 52/26 |
| 2014/0318032 | A1* | 10/2014 | McCarthy | E04D 13/10 52/24 |

OTHER PUBLICATIONS

Sno Gem "3" Individual Seam Mount Snow Guard for Standing Seam Metal Roof Systems" Sell Sheet—first accessed Sep. 17, 2015.

* cited by examiner

SNOW GUARD

FIELD OF INVENTION

The present invention relates to a snow guard and in particular a snow guard to which a panel can be removably affixed.

BACKGROUND OF THE INVENTION

Snow guards are affixed to metal panel roofs such as standing seam roofs to prevent snow and ice from sliding off the roof. With the increased use of sheet metal panels in building construction, there has been an increased need to address ways in which various snow guards are interconnected or joined to a metal panel surface. In various climates, it may be desirable to position a snow retention device on a metal roof to control/inhibit/impede the movement of snow and/or ice down the pitch of the roof.

In some regions, metal roofs are designed to shed snow, therefore limiting excessive snow from building up and potentially damaging or collapsing the structure. However, in most situations sliding snow and/or ice from metal roofs can be hazardous to people, the surrounding landscape, property, and building components. Therefore, steps must be taken to control the sliding snow. For example, snow or ice sliding from a roof above an entryway may injure a passersby. Similarly, falling snow or ice can do damage to landscape features, such as shrubs, and property or building components, including automobiles or lower roofing portions resulting in possible liability to a building owner. In addition, sliding snow or ice can shear off antennas, gutters or other components attached to a building roof or wall, thereby potentially causing a leak. The problem of sliding snow or ice is particularly experienced in connection with metal roofs, including raised seam roofs, (e.g., standing seam) where there is relatively little friction between the roof and the snow or ice.

Numerous snow guard devices have been developed and used in the prior art. However, there are a number of problems generally associated with some prior known and developed snow guard devices. For example, many of the prior art devices are attached to roof by a screw, nail, or other fastener which pierces the roofing surface. Such piercing of the roof can lead to undesirable leakage due to inadequate sealing or shearing of the fastener by the forces exerted thereon by sliding snow and/or ice. Alternate methods for attachment of snow guard devices to roofs such as adhesive bonding may fail to provide secure attachment and/or may be difficult to install on a sloped surface, particularly where the device is applied to a smooth non-porous roofing material such as metal. Other known snow guard systems include a plurality of mounting blocks attached to multiple raised seams and linearly aligned such that a continuous snow rail can be connected to the plurality of mounting blocks. The continuous snow rail in such systems spans across the tops of multiple raised seams and therefore do not make contact with snow depths less than the height of a raised seam. In addition, many snow guard devices may be unsightly and not visually attractive to some individuals.

SUMMARY OF THE INVENTION

The present invention relates to a snow guard designed to be placed over and attached or affixed to a raised seam in a metal roof and which allows a panel made of the same material as the metal roof to be removably affixed to the front of the snow guard. As a result, the present device blends in with the color of the roof being much less visually distracting. The snow guard includes a plate having a front side and a back side opposite the front side and a base that extends from the back side of the plate and that terminates in a distal end. A first flange is positioned along one edge of the plate, and a second flange is positioned along the other edge of the plate opposite the first flange.

The first flange is an L-shaped flange that extends from the front side of the plate and defines a first vertical slot such that the first vertical slot faces towards the center of the plate. The second flange is a mirror image of the L-shape of the first flange and defines a second vertical slot, such that the second vertical slot also faces towards the center of the plate. The first vertical slot and the second vertical slot are open at both the top and the bottom of the plate, allowing a panel to be slid vertically downward along the front side of the plate with the edges of the panel positioned within the first and second vertical slots.

Furthermore, a groove is defined in the snow guard, extending along the entire length of the snow guard from the front side of the plate to the distal end of the base, so that when the snow guard is installed the groove is placed over the raised seam of the metal roof. The groove is of sufficient depth that when the snow guard is installed and the groove is placed over the raised seam of a metal roof, the bottom surface of the snow guard is in close proximity to the deck of the metal roof. In one advantageous form, the bottom surface of the snow guard can rest flush against the deck of the metal roof.

The base also defines one or more holes which extend transversely through the base and which are in communication with the groove. The holes are threaded and generally used along with fasteners such as set screws or threaded bolts made of stainless steel which are tightened using an Allen or hex type fastener to attach the base to the raised seam.

In use, a panel chosen from a material which is similar in appearance to the metal roof is slidably inserted between the first and second flanges such that the panel is held adjacent to the front side of the plate. In preparation for installing the panel, one first forms a cutout in the panel which corresponds in position and size to the groove of the snow guard (i.e., slightly larger than the width of the raised seam of the metal roof). Accordingly, the panel will straddle the metal seam when installed and therefore snow guard will be less noticeable. This notch in the insert also allows the roof colored insert to come below the seam height.

In one alternative form, a snow guard includes a plate having a front side back side opposite the front side and a base in which the snow guard via the base is attached to a conventional clamp such as a popular utility clamp which attaches to a standing seam. Like the prior embodiment, the plate has a first vertical slot and a left vertical slot one either edge of the plate which receives an insertable panel.

BRIEF DESCRIPTION OF THE DRAWINGS

The present invention will now be described with regard to the drawings as follows.

DETAILED DESCRIPTION

Figure 1:
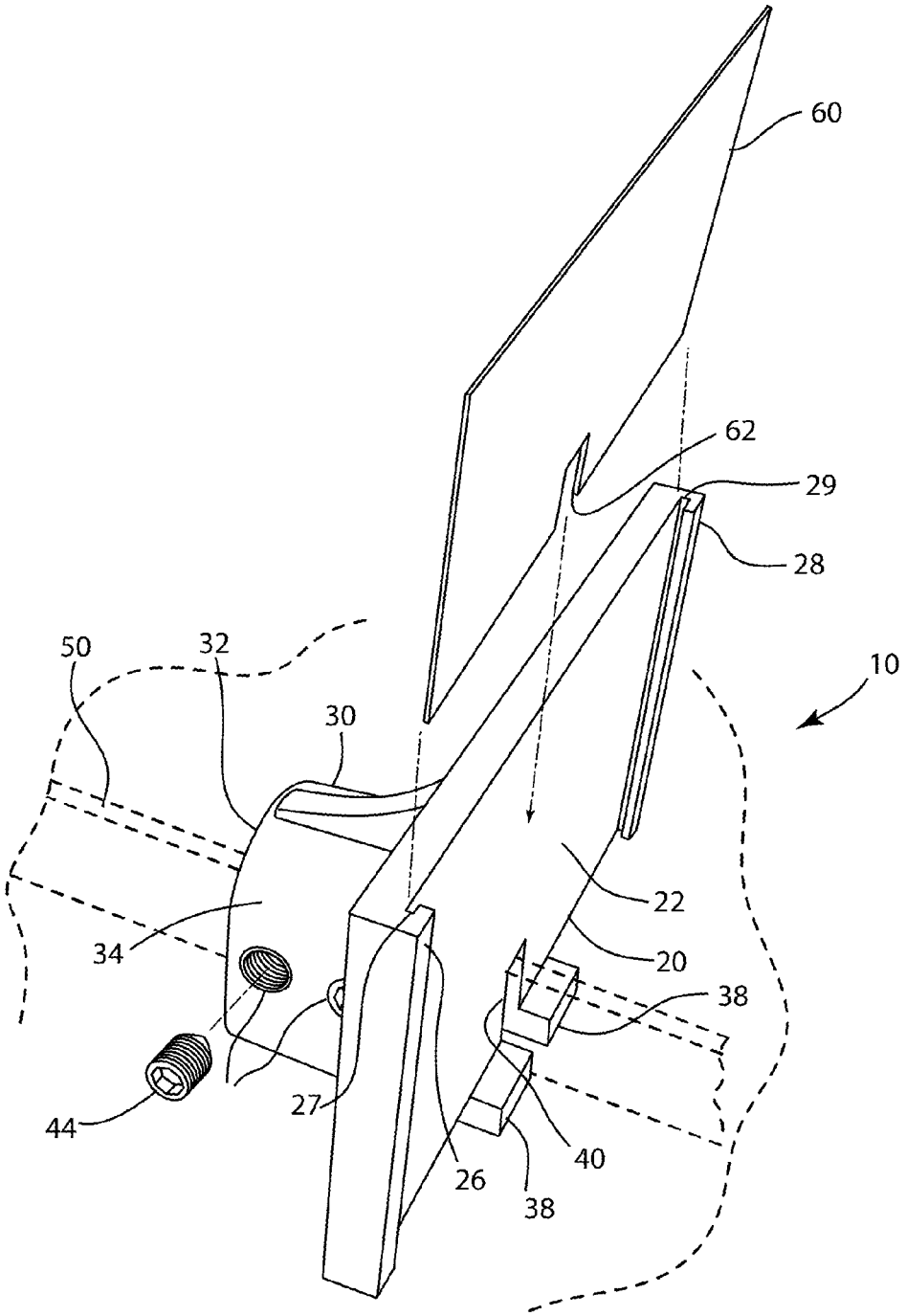
FIG. 1 is a perspective view of a snow guard made in accordance with the present invention shown installed on a raised seam of a metal roof and with an insertable panel shown above the snow guard.

The present invention will now be described with reference to the figures. Referring specifically to FIG. 1, snow guard 10 includes a plate 20 having a front side 22 and a back side 24 opposite the front side 22 and a base 30 that extends from the back side 24 of the plate 20 and that terminates in a distal end 32. A first flange 26 is positioned along one edge of the plate 20, and a second flange 28 is positioned along the other edge of the plate 20 opposite the first flange 26. A groove 40 is defined in the snow guard 10, the groove 40 extending along the entire length of the snow guard 10 from the front side 22 of the plate 20 to the distal end 32 of the base 30. The snow guard 10 is designed such that the base 30 can be installed along a raised seam 50 of a metal roof with the groove 40 placed over the raised seam 50, and such that a panel 60 can be removably attached to the plate 20 adjacent to the front side 22 of the plate 20.

The first flange 26 is an L-shaped flange that extends from the front side 22 of the plate 20 and defines a first vertical slot 27 such that the first vertical slot 27 faces towards the center of the plate 20. The second flange 28 is a mirror image of the first flange 26 and defines a second vertical slot 29, such that the second vertical slot 29 also faces towards the center of the plate 20. In this way, the first vertical slot 27 and the second vertical slot 29 face each other from opposite sides of the plate 20.

Furthermore, as shown in FIG. 1, the first vertical slot 27 and the second vertical slot 29 are open at both the top and the bottom of the plate 20, such that when viewed from above, the plate 20, the first flange 26 and the second flange 28 form a generally C-shaped cross section. The open top of the first and second vertical slots 27, 29 allows one to slide the panel 60 vertically downward along the front side 22 of the plate 20 with the edges of the panel 60 positioned within the first and second vertical slots 27, 29. To prevent the panel 60 from sliding out of the bottom of the first and second vertical slots 27, 29, one or more projections 38 extend from the base 30 directly below the plate 20 and on either side of the groove 40. As the panel 60 is slid into place, the panel 60 comes into contact with the one or more projections 38 preventing the panel 60 from sliding past the bottom of the plate 20.

Figure 2:
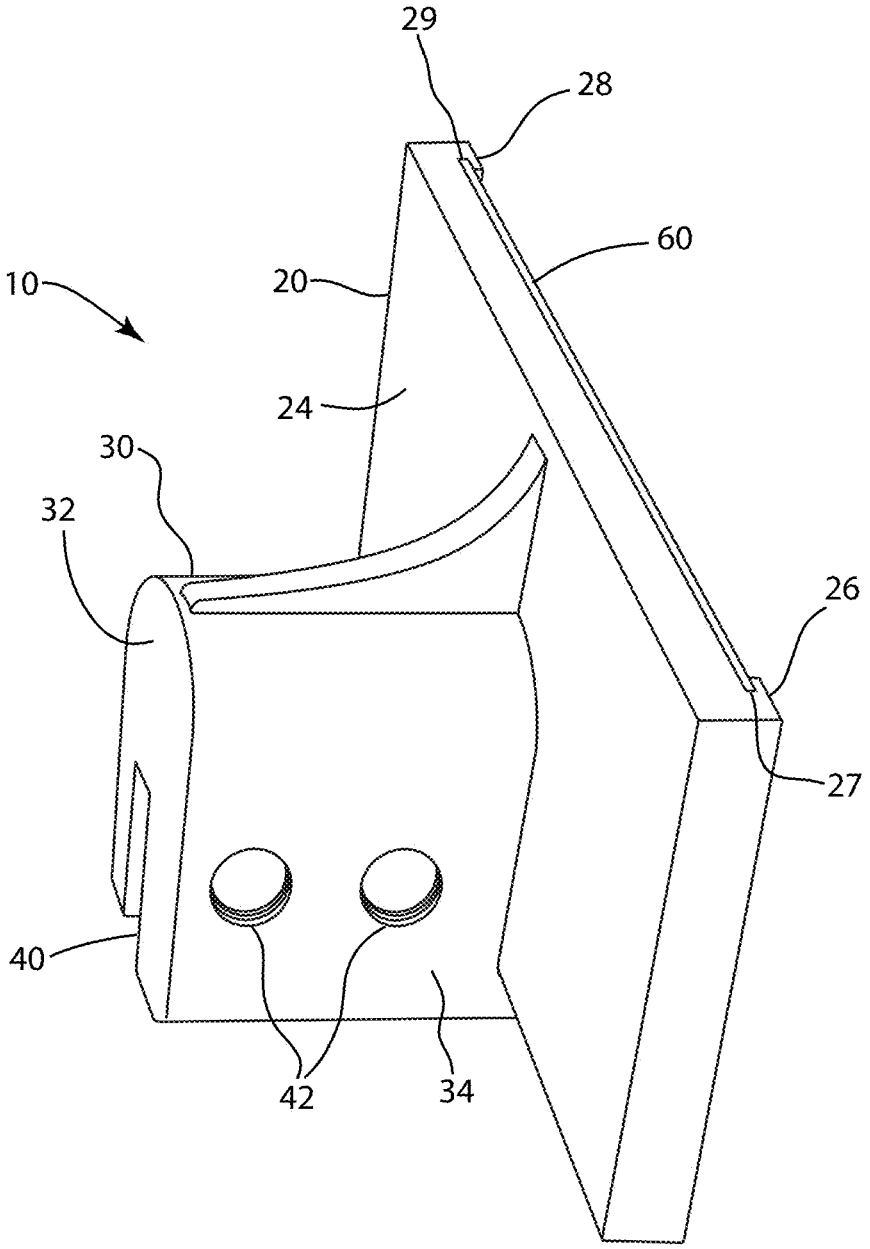
FIG. 2 is a rear perspective view of the snow guard of FIG. 1 with the panel attached.

Referring now to FIGS. 1 and 2, the groove 40 extends from the front side 22 of the plate 20 to the distal end 32 of the base 30 along the entire length of the snow guard 10. Furthermore, the groove 40 is of sufficient depth that when the snow guard 10 is installed and the groove 40 is placed over the raised seam 50 of a metal roof, the bottom surface of the snow guard 10 rests flush against the deck of the metal roof. Alternatively, snow guard 10 can be installed slightly above the deck of the metal roof if desired, leaving a gap between the bottom of the snow guard 10 and the deck of the metal roof.

Referring still to FIGS. 1 and 2, the base 30 has a first lateral surface 34 on one side of the base 30 and a second lateral surface opposite the first lateral surface 34. The first lateral surface 34 of the base 30 defines two holes 42 which extend transversely through the base 30 from the first lateral surface 34 to the groove 40. As perhaps best shown in FIG. 1, the holes 42 are generally threaded and used along with fasteners such as set screws 44 made of stainless steel which are tightened using an Allen or hex type fastener to attach the base 30 to the raised seam 50. Specifically, the screws 44 are advanced through the holes 42 until the ends of the screw enter the groove 40 and contact the raised seam 50.

Although not shown, two additional threaded holes extend transversely through the base from the second lateral surface to the groove 40. The two additional holes are substantially identical to the two holes 42 shown in FIG. 2 and aligned such that the longitudinal axis of the holes 42 shown in FIG. 2 are substantially aligned with the longitudinal axis of two additional holes. As such, when the snow guard 10 is installed, the raised seam 50 is pinched between the points of screws on either side of the raised seam at two separate portions of the raised seam 50, thus holding the snow guard 10 in place relative to the raised seam 50 of the metal roof.

With regard to the screws used with the snow guard 10 of the present invention, it is contemplated that in addition to set screws 44, alternatively the screws can have points of any shape known in the art, such as, for example, a flat point, domed point, cone point, or dog point; however, the screws should ideally secure the snow guard 10 to the raised seam 50 without damaging or marring the surface of the raised seam 50, and so preferably the screw has a point which would minimize the damage to the surface of the raised seam 50, such as, for example, a cup point, ball point, or ball bearing point.

Of course, the number and position of holes, and therefore the number of screws, may vary without departing from the spirit and scope of the present invention. For example, in some embodiments, holes are defined on only one side of the base, such that when the screws are advanced through the holes, the raised seam will be compressed by the screw points against the interior wall of the groove opposite from the screw points. Furthermore, in an embodiment where two holes are defined on one side of the base (similar to the configuration shown in FIGS. 1 and 2) and a single hole is defined on the opposite side of the base, it is contemplated that the single hole would be offset from the two holes such that, when the snow guard is installed, a screw advanced through the single hole would engage a portion of the raised seam located between the portions of the raised seam engaged by the screws advanced through the two holes. In other words, the longitudinal axis of the two holes defined on the one side of the base are offset and on either side of the longitudinal axis of the single holes defined on the opposite side of the base.

Alternatively, the snow guard 10 can have other different screw hole/threaded bore configurations which are known to one of ordinary skill in the art. Different configurations include a screw configuration in which a pair of threaded holes on one side of the base 30 (total of four, 2 by 2) are axially aligned with a corresponding pair of holes on the other side of base 30, across the groove 40. Accordingly, tightening down bolts on both sides of groove 40 result in pressure being applied on both sides of the seam with screws on opposite sides of the groove apply pressure towards each other. Alternatively, a single screw can be used on a single side of the base 30, one screw on each respective side of base 30, and two set screws/bolts on a single side of base 30 may be used to attach the snow guard to a standing seam. Again, one skilled in the art will be readily aware of different screw configurations and number of screws that may be used to attach snow guard 10 to a standing seam 50.

Figure 3:
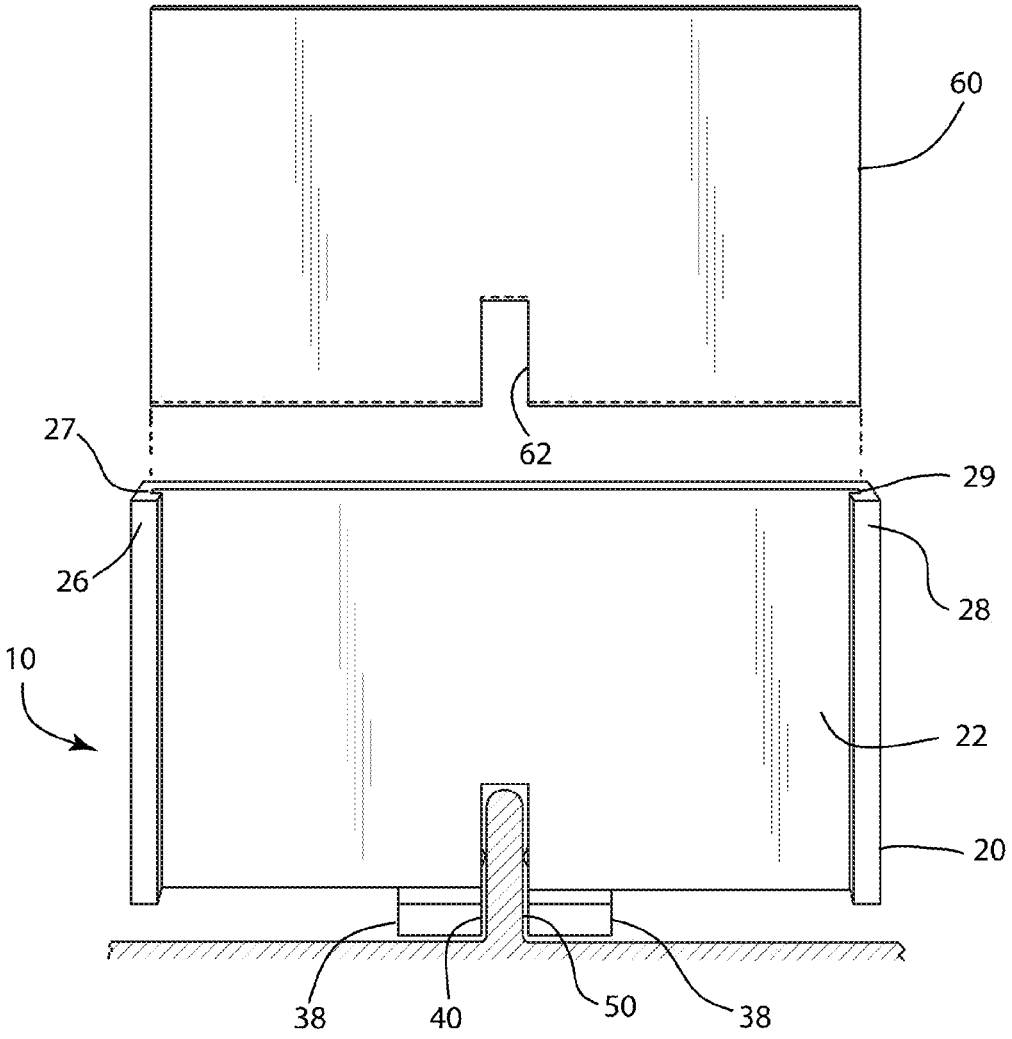
FIG. 3 is a front view of the snow guard of FIG. 1.

Referring now to FIGS. 1 and 3, in use, one slidably inserts a panel 60 between the first and second flanges 26, 28 such that the panel 60 is held adjacent to the front side 22 of the plate 20. The panel 60 is preferably chosen from a material which is similar in appearance to the metal roof, so that the snow guard 10 will be less noticeable when installed. In fact, one can cut a blank from the same material used for the roof in order to form the panel. As shown in FIGS. 1 and 3, the panel 60 includes a cutout 62 which corresponds in position and size to the groove 40 of the snow guard 10 (i.e., slightly larger than the width of the raised seam 50 of the metal roof), such that when the snow guard 10 is installed and the panel 60 is attached to the plate 20, the cutout 62 of the panel 60 straddles the raised seam 50, however, because the panel 60 rests on the projections 38, there is still a gap between the panel 60 and the roof deck, thus allowing melting snow or rain water to pass beneath the panel 60.

In preparation for installing the panel 60, one can form the cutout 62 by first providing a panel 60 sized to slidably engage the first and second vertical slots 27, 29 of the plate 20 and then cutting two parallel lines corresponding in position and size to the groove 40 of the snow guard 10. The resultant tab (i.e., the area between the two parallel lines) can then be removed or simply folded backward and upward to rest against the back side of the panel 60, thus forming the cutout 62 shown in FIGS. 1 and 3. In the alternative, after cutting the two parallel lines, but prior to folding back the resultant tab, one can slide the panel 60 into place along the front side 22 of the plate 20. One then folds the tab backward into the groove 40 of the snow guard 10 (i.e., about a 90° bend) and proceeds to install the snow guard 10 with the panel 60 attached onto the raised seam 50. In this way, when the snow guard 10 is installed on the raised seam 50, the tab of the panel 60 is positioned between the raised seam 50 and snow guard 10 within the groove 40 of the snow guard 10, thus preventing the panel 60 from being removed from the plate 20 without first uninstalling the snow guard 10 from the raised seam 50.

Alternatively, should it be desired, a panel 60 can be inserted into the vertical slots 27, 29 without creating a cut out 62. In this embodiment, a generally complete rectangular panel will be used without a cut out, and the panel is inserted into the vertical slots 27, 29. The panel 60, when the snow guard is attached to a standing seam 50 will have its bottom surface adjacent a top surface of a standing seam 50.

Figure 4:
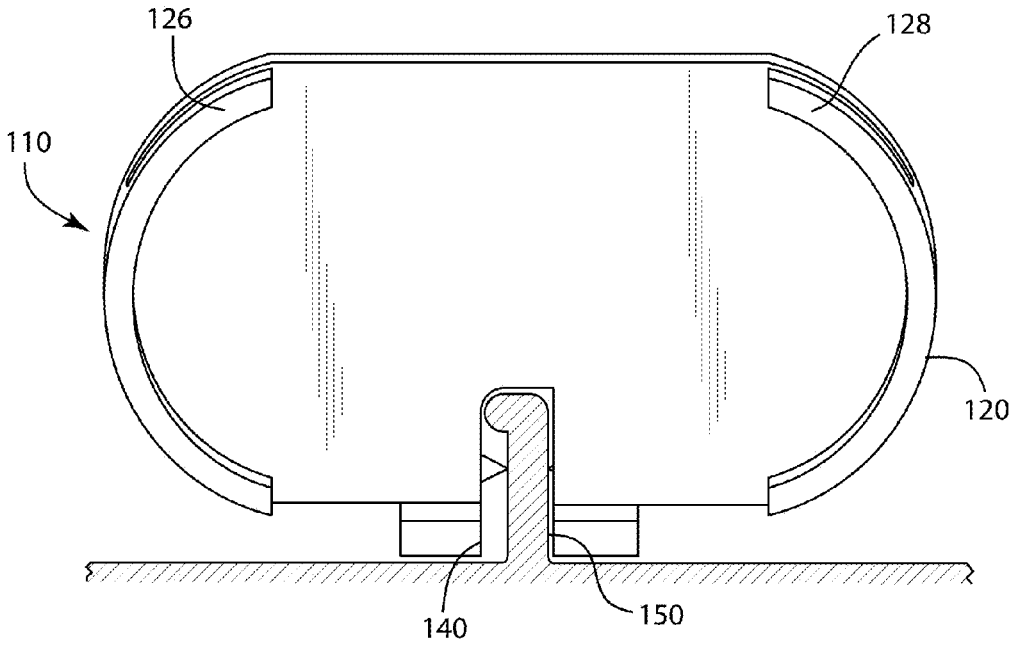
FIG. 4 is a front view of another snow guard made in accordance with the present invention.

Referring now to FIG. 4, in another exemplary embodiment of the present invention, a snow guard 110 is provided which is substantially the same as the snow guard 10 described above with reference to FIGS. 1-3 except for the shape of the plate 120. Specifically, as shown in FIG. 4, the plate 120 has rounded edges such that the first and second flanges 126, 128 are curved. Other shapes of the plate are also possible without departing from the spirit and scope of the present invention.

Figure 5:
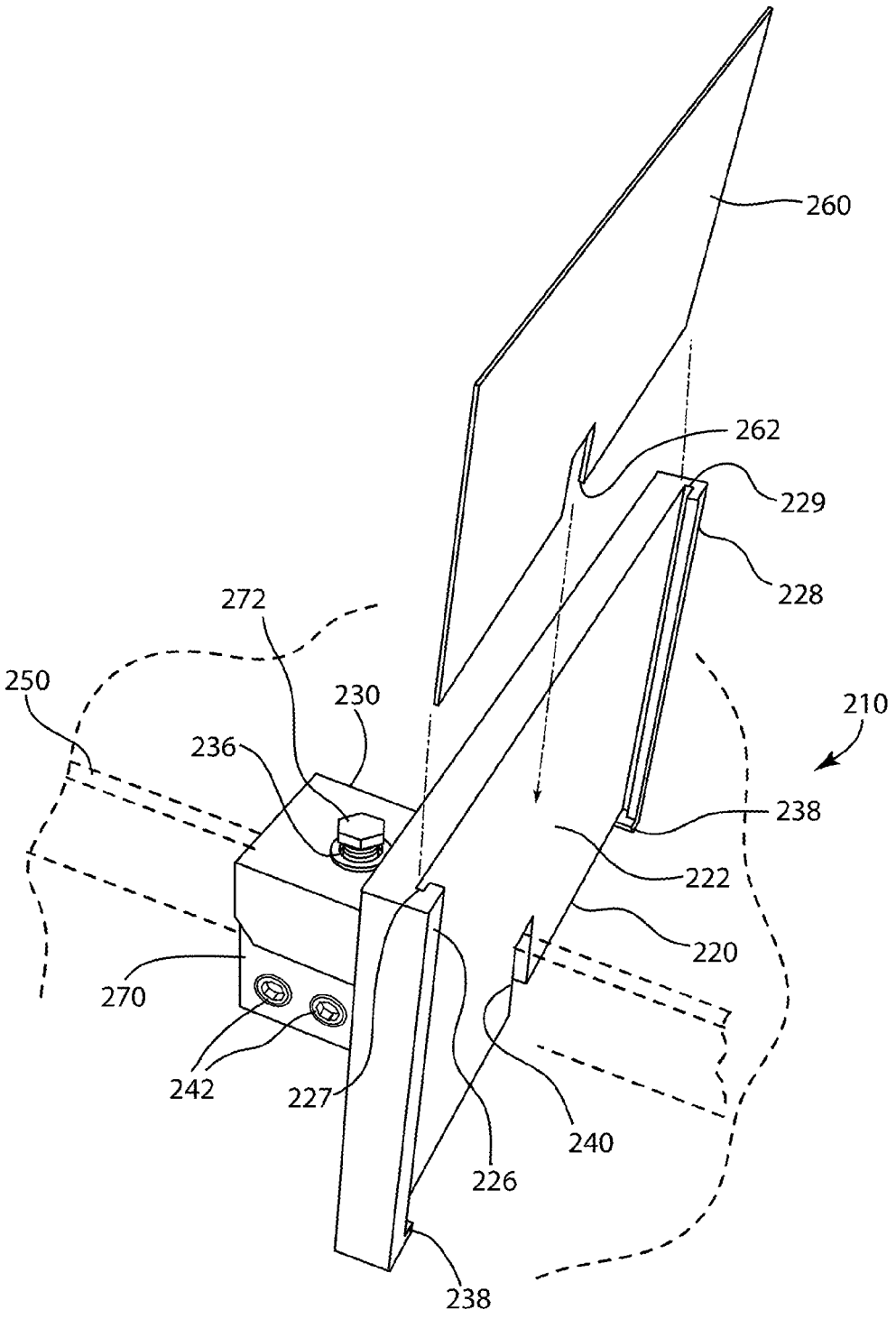
FIG. 5 is a perspective view of a different snow guard, viewed from the front, in accordance with another embodiment of the present invention shown affixed to an intermediate element such as a clamp, which, in turn is attached to a raised seam of a metal roof.
Figure 6:
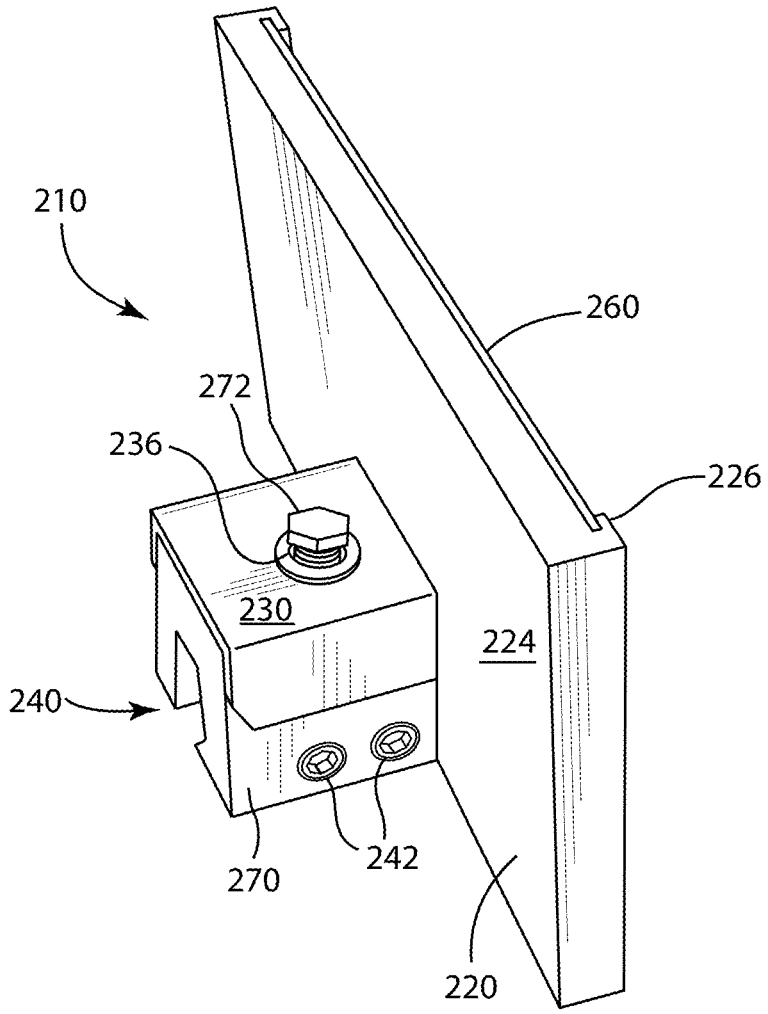
FIG. 6 is the snow guard and seam clamp of FIG. 5 viewed from the rear of the snow guard.
Figure 7:
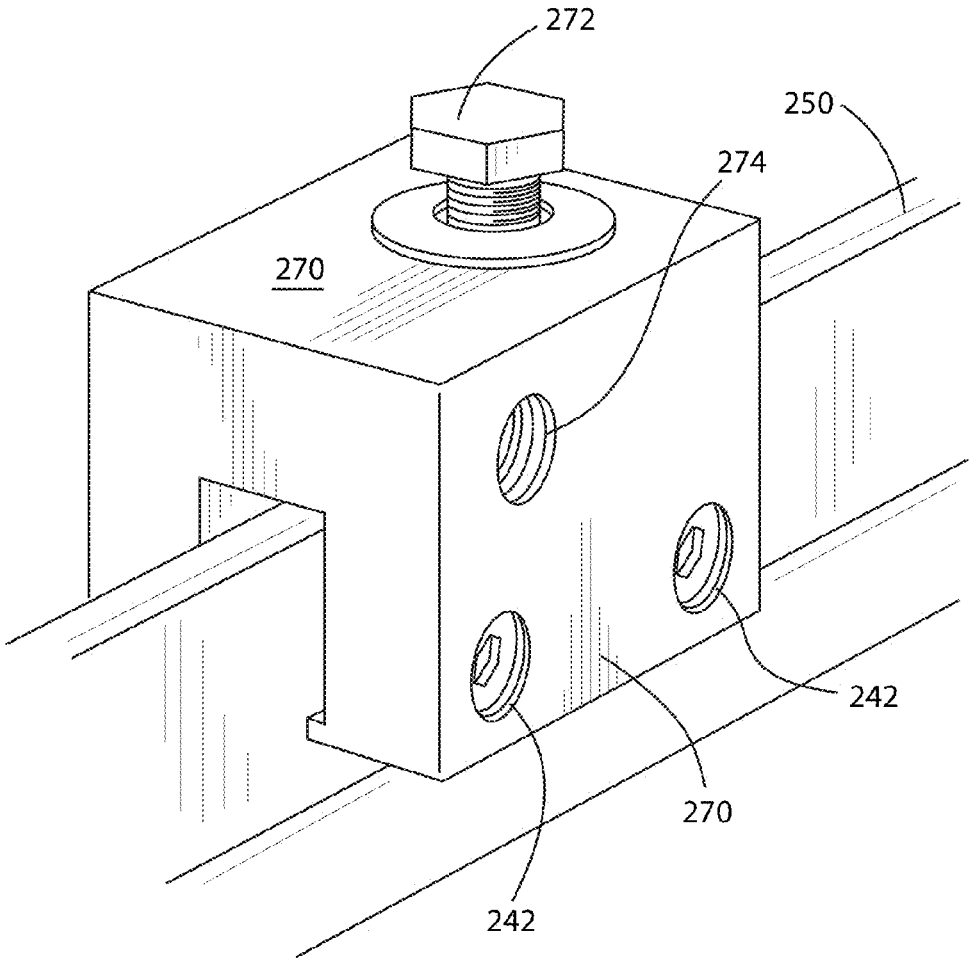
FIG. 7 is a perspective view of a clamp used to attach the snow guard of FIG. 5 to a standing seam room in accordance with the present invention.
Figure 8:
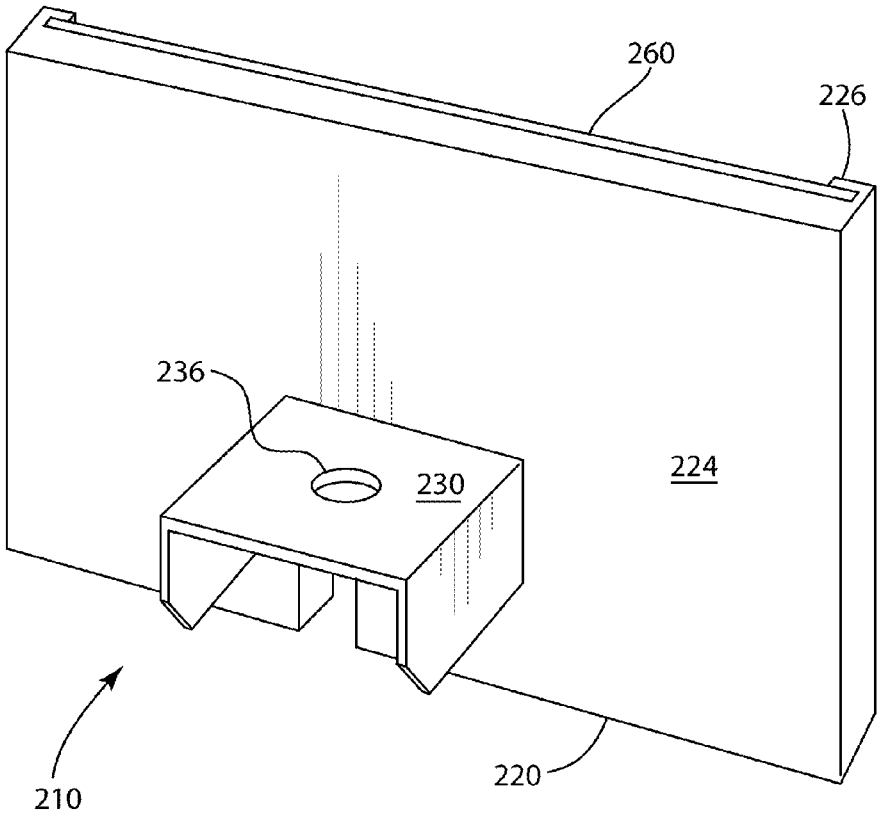
FIG. 8 is the snow guard of FIG. 5, shown without being attached to the seam clamp.

Referring now to FIGS. 5-8, snow guard 210 is another exemplary embodiment of the present invention. Snow guard 210 is substantially the same as snow guard 10 described above with regard to FIGS. 1-3 except for its base 230 and its attachment to a standing seam 250. Snow guard 210 attaches to an intermediate element such as a utility clamp 270. FIG. 7 shows the clamp 270 attached to the standing seam 250. Two threaded bores or holes 242 (shown in FIGS. 5-7) and a second pair of threaded bores or holes on the opposite side of the clamp 270 axially aligned with the holes 242 across the groove 240 or axially offset with a single hole across the groove 240, in conjunction with screws (not shown) attach the clamp 270 to the standing seam 250. Referring to FIGS. 5, 6, and 8, the base 230 has a hole 236 on its top surface (best shown in FIG. 8). A bolt 272 is inserted through the hole 236 to join the snow guard 210 to the clamp 270. An additional threaded bore or hole 274 can receive another bolt, like bolt 272. It will be appreciated that while clamp 270 has a pair of threaded bores on each side or a pair on one side and a single threaded bore on the other side, other bore configurations are possible for attaching the clamp to a standing seam which will be apparent to one of ordinary skill in the art.

In an alternative to base 230, the base can have different shapes which allow the snow guard 210 to attach to clamp 270 or another standing seam clamp currently available and/or know in the art today or developed in the future.

Upon installation, panel 260 is disposed in vertical slots 227, 229 with the standing seam 250 traversing cut out 262. A bottom surface of the panel 260 may rest on ledges 238 disposed on either side of the bottom of plate 220. Alternatively, the snow guard 210 can omit ledges 238, and the panel 260 can rest on the surface of the metal roof and/or standing seam 250.

It will now be clear to one of ordinary skill in the art that the present invention provides features and advantages not found in prior snow guards. These features include an ability to removably attach a panel 60, 260 to the front side 22, 222 of the plate 20, 220. Advantageously, the panel can be made of the same material as the roof as to exactly match the color of the roof so that the snow guard 10, 210 is less noticeable when installed.

One of ordinary skill in the art will recognize that additional embodiments are also possible without departing from the teachings of the presently-disclosed subject matter. This detailed description, and particularly the specific details of the exemplary embodiments disclosed herein, is given primarily for clarity of understanding, and no unnecessary limitations are to be understood therefrom, for modifications will become apparent to those skilled in the art upon reading this disclosure and can be made without departing from the spirit and scope of the presently-disclosed subject matter.

What is claimed is:

1. A snow guard, comprising:

a plate having a front side, a back side opposite the front side top and bottom;

a base disposed towards the bottom of the plate and off-center relative to a surface of the plate and extending transversely from the back side of the plate and terminating in a distal end, the base having a first lateral surface and a second lateral surface opposite the first lateral surface; and a removably attachable panel defining a cutout, wherein, when the panel is attached to the plate, the cutout is substantially aligned with a groove defined by the plate and the base, the groove extending from the front side of the plate to the distal end of the base.

2. The snow guard of claim 1, wherein the plate further comprises:

a first flange extending from the front side of the plate, the first flange defining first vertical slot; and a second flange extending from the front side of the plate, the second flange defining a second vertical slot, such that the first vertical slot faces the second vertical slot.

3. The snow guard of claim 1, further comprising one or more projections extending from the base below the plate.

4. The snow guard of claim 1, wherein the plate defines a first vertical slot adjacent to one edge of the plate and a second vertical slot adjacent to an opposite edge of the plate, the first vertical slot and second vertical slot extending in a direction from the top to the bottom of the plate.

5. The snow guard of claim 4, wherein the base defines one or more holes extending transversely through the base, the one or more holes in communication with the groove.

6. The snow guard of claim 5, wherein the one or more holes comprise a first hole extending transversely through the base from the first lateral surface to the groove.

7. The snow guard of claim 6, wherein the one or more holes further comprises a second hole extending transversely through the base from the second lateral surface to the groove; and wherein the first hole and the second hole are axially aligned.

8. The snow guard of claim 6, wherein the one or more holes further comprises a pair of holes extending transversely through the base from the second lateral surface to the groove, wherein a longitudinal axis of the pair of holes are offset and positioned on either side of a longitudinal axis of the first hole.

9. The snow guard of claim 4, wherein the removably attachable panel includes a first edge configured to slidably engage the first vertical slot, and a second edge configured to slidably engage the second vertical slot, such that, when the panel is attached, the panel is adjacent to the front side of the plate.

10. The snow guard of claim 1, wherein the groove is defined at a central portion of the plate, such that a substantial portion of the plate is on either side of the groove.

11. The snow guard of claim 1, wherein the base extends substantially all the way to the bottom of the plate.

12. A snow retention system, comprising:

one or more snow brakes configured for individual attachment to a respective raised seam of a metal roof, each snow brake including a plate having a front side, a back side opposite the front side, top and bottom;

a base disposed towards the bottom of the plate extending from the back side of the plate and terminating in a distal end, the base being off-center relative to a surface of the plate;

a groove defined by the plate and the base, the groove extending from the front side of the plate to the distal end of the base;

a removably attachable substantially panel defining a cut-out; and a means of removably attaching a substantially planar panel with edges to the front side of the plate.

13. The snow retention system of claim 12, wherein for each of the one or more snow brakes a groove is defined through the plate and the base, the groove extending from the front side of the plate to the distal end of the base and configured to receive the respective raised seam of the metal roof, such that, when the respective raised seam is received in the groove, the front side of the plate is substantially perpendicular to the raised seam of the metal roof.

14. The snow retention system of claim 13, wherein for each of the one or more snow brakes, when the respective raised seam is received in the groove, a portion of the plate is positioned on either side of the raised seam.

15. The snow retention system of claim 14, wherein for each of the one or more snow brakes the panel defines a cutout, such that, when the panel is attached to the front side of the plate, the cutout is substantially aligned with the groove and a portion of the panel is adjacent to the portion of the plate positioned on either side of the raised seam.

16. The snow retention system of claim 13, wherein for each of the one or more snow brakes further comprises one or more projections extending from the base below the plate and on either side of the groove, such that, when the panel is attached to the front side of plate, a bottom edge of the panel rests on the one or more projections.

17. The snow retention system of claim 12, wherein for each of the one or more snow brakes the means of attaching the panel to the front side of the plate comprises:

a first flange extending from the front side of the plate and defining a first vertical slot; and a second flange extending from the front side of the plate and defining a second vertical slot, such that the first vertical slot faces the second vertical slot, such that the first vertical slot and the second vertical slot are configured to slidably receive the panel.

18. A method of installing a snow guard onto a raised seam of a metal roof, comprising the steps of:

providing a snow guard including a plate with a front side and a back side, and a base extending from the back side of the plate, wherein a groove is defined by the snow guard, the groove extending through the plate and the base substantially perpendicular to the front side of the plate;

attaching a panel to the front side of the snow guard, the panel defining a cutout that is substantially aligned with the groove when the panel is attached to the front side of the snow guard; and securing the snow guard to the raised seam wherein the raised seam is received in the groove and the front side of the plate is substantially perpendicular to the metal roof.

19. The method of claim 18, wherein the snow guard further includes a first flange extending from the front side of the plate and a second flange extending from the front side of the plate; and wherein the step of attaching the panel to the front side of the snow guard comprises sliding the panel along the front side of the plate with a first edge of the panel engaging the first flange and a second edge of the panel opposite the first edge engaging the second flange.

20. The method of claim 18, further comprising the steps of:

creating a tab in the panel, the tab corresponding in position and size to the groove of the snow guard; and folding the tab backward into the groove after attaching the panel to the front side of the snow guard;

wherein, when the snow guard is secured to the raised seam, the tab is positioned between the raised seam and the snow guard within the groove of the snow guard.

21. A snow guard, comprising:

a plate having a front side, and a back side opposite the front side;

a base extending transversely from the back side of the plate and terminating in a distal end, the base having a first lateral surface and a second lateral surface opposite the first lateral surface; and a removably attachable panel selectively attachable to the plate and having a cut out;

wherein the plate defines a first vertical slot adjacent to one edge of the plate and a second vertical slot adjacent to an opposite edge of the plate; and wherein a groove is defined by the plate and the base, the groove extending from the front side of the plate to the distal end of the base and alignable with the cut out in the panel.

* * * * *